US008602772B2

(12) United States Patent
Fan et al.

(10) Patent No.: US 8,602,772 B2
(45) Date of Patent: Dec. 10, 2013

(54) ASSISTED COMMISSIONING METHOD FOR COMBUSTION CONTROL SYSTEM

(75) Inventors: Junqiang Fan, Glastonbury, CT (US); Muhidin A. Lelic, Londonderry, NH (US); Guido Poncia, Glastonbury, CT (US); David S. Liscinsky, Glastonbury, CT (US); Meredith B. Colket, III, Simsbury, CT (US); Tom Kennedy, Neward, DE (US)

(73) Assignee: UTC Fire & Security Corporation, Farmington, CT (US)

( * ) Notice: Subject to any disclaimer, the term of this patent is extended or adjusted under 35 U.S.C. 154(b) by 694 days.

(21) Appl. No.: 12/918,444

(22) PCT Filed: Feb. 20, 2008

(86) PCT No.: PCT/US2008/054393

§ 371 (c)(1),
(2), (4) Date: Nov. 12, 2010

(87) PCT Pub. No.: WO2009/105094

PCT Pub. Date: Aug. 27, 2009

(65) Prior Publication Data

US 2011/0162591 A1 Jul. 7, 2011

(51) Int. Cl.
*F23N 1/02* (2006.01)

(52) U.S. Cl.
USPC ..... 431/2; 431/6; 431/12; 700/274; 700/289

(58) Field of Classification Search
USPC ..... 431/2, 6, 12, 18; 700/274, 289
See application file for complete search history.

(56) References Cited

U.S. PATENT DOCUMENTS

| | | | |
|---|---|---|---|
| 3,405,998 | A | 10/1968 | Walbridge |
| 3,441,356 | A | 4/1969 | Walbridge |
| 3,504,992 | A | 4/1970 | Walbridge |
| 3,770,364 | A | 11/1973 | Walbridge |
| 3,987,346 | A | 10/1976 | Riordan |
| 4,087,230 | A | 5/1978 | Matthews |
| 4,133,629 | A | 1/1979 | Clark |
| 4,389,184 | A | 6/1983 | Tanaka et al. |
| 4,438,497 | A | 3/1984 | Willis et al. |
| 4,474,549 | A | 10/1984 | Capone |
| 4,531,905 | A | 7/1985 | Ross |
| 4,676,734 | A | 6/1987 | Foley |

(Continued)

FOREIGN PATENT DOCUMENTS

GB 1240957 A 7/1971

OTHER PUBLICATIONS

Boiler Combustion Control; Eurotherm Boiler Combustion Control; http://www.eurotherm.com/boiler/Combustion.htm, Dec. 12, 2007; 1 pg.

(Continued)

*Primary Examiner* — Kenneth Rinehart
*Assistant Examiner* — Jorge Pereiro
(74) *Attorney, Agent, or Firm* — Cantor Colburn LLP

(57) ABSTRACT

A method is provided for commissioning a combustion control system for controlling operation of a boiler combustion system. The method includes the step of mapping a plurality of sets of coordinated servo positions for the fuel flow control device and the air flow control device at a plurality of selected firing rate points between a minimum firing rate and a maximum firing rate by using an algorithm and an iterative process to identify the coordinated air and fuel actuator positions instead of a trial and error method.

8 Claims, 4 Drawing Sheets

(56) References Cited

U.S. PATENT DOCUMENTS

| | | | |
|---|---|---|---|
| 4,695,246 | A | 9/1987 | Beilfuss et al. |
| 4,783,600 | A | 11/1988 | Chang |
| 4,891,004 | A | 1/1990 | Ballard et al. |
| 4,927,351 | A | 5/1990 | Hagar et al. |
| 5,049,063 | A | 9/1991 | Kishida et al. |
| 5,601,071 | A | 2/1997 | Carr et al. |
| 5,785,512 | A | 7/1998 | Cormier |
| 5,880,411 | A | 3/1999 | Gillespie et al. |
| 6,024,561 | A | 2/2000 | Kemp et al. |
| 6,042,365 | A | 3/2000 | Chen |
| 6,338,018 | B1 | 1/2002 | Baker |
| 6,764,298 | B2 | 7/2004 | Kim et al. |
| 2006/0078837 | A1 | 4/2006 | Jaeschke et al. |
| 2006/0106498 | A1 | 5/2006 | Jaeschke et al. |
| 2006/0172238 | A1 | 8/2006 | Cook |
| 2008/0003530 | A1 | 1/2008 | Donnelly et al. |

OTHER PUBLICATIONS

Burner Combustion Control for Boilers; Boiler Industry; Part No. HR084053U001, Issue 2, Printed in England Feb. 2003, 2 pgs.

Combustion Control Strategies for Single and Dual Element Power Burners, David C. Farthing, Federal Corporation, Steam Digest 2002, pp. 29-34.

Optimizing Combustion Controls, posted Oct. 9, 2007, http://www.industrialheating.com/copyright/BNP_GUID_9-5-2006_A_1000000000000183794?view= . . . , Nov. 27, 2007, pp. 1 of 5.

International Search Report and Written Opinion mailed Jul. 14, 2008, 10 pgs.

ASSISTED COMMISSIONING METHOD FOR COMBUSTION CONTROL SYSTEM

FIELD OF THE INVENTION

This invention relates generally to natural gas and oil fired boilers and, more particularly, to combustion control systems for industrial and commercial natural gas and oil fired, steam/hot water boilers.

BACKGROUND OF THE INVENTION

Combustion controllers are commonly employed in connection with industrial and commercial boilers for modulating air flow and fuel flow to the burner or burners of the boiler. One type of combustion controller uses parallel positioning of air flow and fuel flow actuators to modulate air flow and fuel flow over the entire operating range of the boiler to ensure the safety, efficiency, and environmental requirements of combustion can be satisfied across the entire operating range. In parallel positioning control systems, the combustion controller controls air flow by manipulating actuators associated with a set of air dampers and/or a variable frequency driver operatively associated with a variable speed air flow fan. The combustion controller also independently controls fuel flow by manipulating fuel actuators, such as solenoid valves or other types of flow servo valves, to increase or decrease fuel flow to match the desired firing rate.

The operating range of a boiler is generally defined by its firing range between a low fire point commensurate with the minimum firing rate at which combustion is sustainable and a high fire point commensurate with the maximum energy output of the burner. The firing range depends on the boiler's burner's turndown ratio, that is, the ratio between the highest energy output and the lowest energy output. For each given firing rate within the boiler firing range a pair of suitable positions of the air supply and fuel supply actuators must be defined. Each pair of actuator positions then corresponds to a defined air/fuel ratio that in turns determines efficiency, emissions and stability of combustion for a resultant firing rate. The determined set of coordinated air and fuel actuator positions provides a map or algorithm that is used by the boiler controller during operation of the boiler to modulate the burner fuel valve and the air damper in response to firing rate.

When a combustion control system is first installed on a boiler, the desired air and fuel actuator positions need to be defined at a number of points, i.e. firing rates, within the firing range, because the relationship between the sets of air and fuel actuator positions to firing rate is non-linear. The process of defining the proper fuel and air actuator positions throughout the firing range is commonly referred to as commissioning of the boiler combustion control system. The purpose of the commissioning process is to find a set of coordinated air and fuel actuator positions at various points across the operating range such that safety, efficiency, and environmental requirements can be achieved.

In conventional practice for industrial boilers, commissioning is currently performed manually. A commissioning technician will first set up two pairs of the fuel and air actuator positions conforming to the so-called "ignition point" and "low fire point". Next the technician would select and preset the respective air and fuel actuator positions for all of the firing rates, typically more than a dozen points, from the low firing point to the high firing point. Then, the technician uses a trial and error approach at each these points to search for the acceptable fuel and air actuator positions at each of the firing rate points. Due to the nonlinearities between the actuators, and the flows and the desired air/fuel ratios, this searching process is tedious and the performance is dependent on the experience of the commissioning technician. Further more, it is required to repeat such commissioning within a certain period of time due to either process condition change, such as fuel change, or regulatory requirements.

SUMMARY OF THE INVENTION

A method is provided for commissioning a combustion control system for controlling operation of a boiler combustion system having a burner, a fuel flow control device operatively associated with the burner and an air flow control device operatively associated with the burner. The method includes the step of mapping a plurality of sets of coordinated servo positions for the fuel flow control device and the air flow control device at a plurality of selected firing rate points between a minimum firing rate and a maximum firing rate. The mapping step includes, for at least one of the plurality of selected firing rate points, the steps of:

(a) determining one of either the servo position of the fuel flow control device or the servo position of the air flow control device associated with the selected firing rate point;

(b) defining an excess oxygen content target value for the selected firing rate point;

(c) repositioning the other of the air flow control device or the fuel flow control device from a previous servo position known to be associated with a measured excess oxygen content value less than the excess oxygen content target value to a current servo position estimated to be associated with an excess oxygen content value greater than the target value;

(d) estimating an optimum servo position of the other of the air flow control device or the fuel flow control device for the selected firing rate by applying an algorithm comprising a function of the previous servo position, the current servo position, a measured value of the excess oxygen content at the previous servo position, a measured value of the excess oxygen content at the current servo position, and said excess oxygen target value; and (e) repeating steps (c) and (d) until the measured value of the excess oxygen content at the current servo position falls within a preselected range of said excess oxygen target value, thereby defining the optimum servo position for the other of the air flow control device or the fuel flow control device at the selected firing rate; and (f) saving the optimum servo position for the other of the air flow control device or the fuel flow control device at the selected firing rate and the servo position of the one of the fuel flow control device or the air flow control associated with the selected firing rate at step (a) as a coordinated set associated with the selected firing rate.

In an embodiment, the method of commissioning a combustion control system further includes the step of terminating the repetition of steps (c) and (d) after a preselected number of iterations if the measured excess oxygen content at the then current servo position at the selected firing rate does not fall within the preselected range of the excess oxygen content target value and defining the then current servo positions as the coordinated set associated with the selected firing rate. In an embodiment, the method of commissioning a combustion control system includes the further step of: repeating steps (a) to (f) until a coordinated set of fuel flow control servo position and air flow control servo position has been established at each of a desired plurality of selected firing rate points between the minimum firing rate and the maximum firing rate.

In an embodiment of the method of the invention, the mapping process is conducted with first selecting the fuel flow control servo positions for the selected firing rates and then applying the method of the invention to determine the optimum air flow control servo position at each of the selected firing rates. In another embodiment of the method of the invention, the mapping process is conducted with first selecting the air flow control servo positions for the selected firing rates and then applying the method of the invention to determine the optimum fuel flow control servo position at each of the selected firing rates.

In an embodiment of the method of the invention, the step of estimating an optimum servo position of the other of the air flow control device or the fuel flow control device for the selected firing rate by applying an algorithm comprising a function of the previous air servo position, the current air servo position, a measured value of the excess oxygen content at the previous air servo position, a measured value of the excess oxygen content at the current air servo position, and the excess oxygen target value, comprises applying one of the following two formulae:

$$\tilde{v}_t = \begin{cases} v_b + (v_a - v_b) \times \dfrac{(1 + O_2^t/0.209)(1+\delta) - (1 + O_2^b/0.209)(1+\delta)}{(1 + O_2^a/0.209) - (1 + O_2^b/0.209)(1+\delta)} & (1) \\ v_b + (v_a - v_b) \times \dfrac{O_2^t - O_2^b}{O_2^a - O_2^b} & (2) \end{cases}$$

where: $v_a$ denotes the servo position at the previous firing rate and $v_b$ denotes the initial servo position at the current firing rate, $\delta$ denotes the firing rate change between the current firing rate and the previous firing rate, $O_2^t$, $O_2^a$, and $O_2^b$ represent the target excess oxygen content, the measured concentrations of excess oxygen content at the servo positions $v_a$ and $v_b$, respectively. The first of the formulae is generally applied when the servo position for one of the air flow control device or the fuel flow control device at the second firing rate is different from it respective servo position at the first firing rate. The second of the formulae is generally applied when the servo position for one of the air flow control device or the fuel flow control device at the second firing rate is not changed.

BRIEF DESCRIPTION OF THE DRAWINGS

For a further understanding of the invention, reference will be made to the flowing detailed description of the invention which is to be read in connection with the accompanying drawing, wherein.

DETAILED DESCRIPTION OF THE INVENTION

Figure 1:
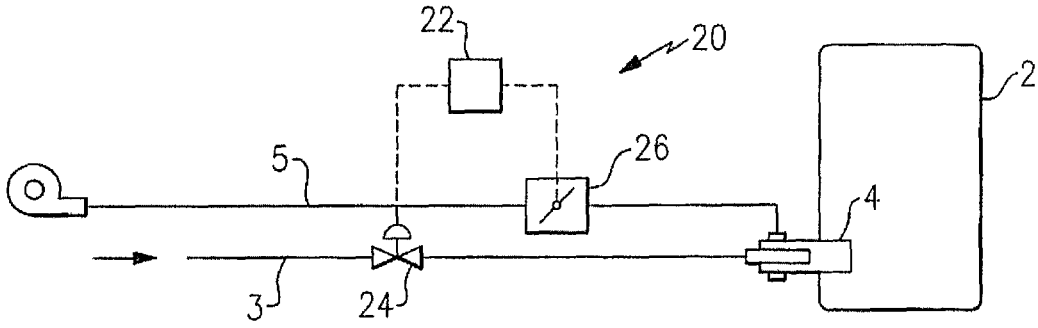
FIG. 1 is a schematic diagram of a combustion system for a steam/hot water boiler.

Referring now to FIG. 1, there is depicted a block diagram representing a parallel positioning combustion control system 20 for controlling fuel flow and air flow to a burner 4 of a hot water or steam boiler 2. The combustion control system 20 includes a fuel flow control device 24, typically a servo-valve, disposed in a fuel supply line 3 to the burner 4 to control the amount of flow supplied to the burner. The combustion control system 20 also includes an air flow control device 26, such as, for example, a damper disposed in an air supply duct 5 to the burner 4, to control the amount of airflow supplied to the burner. The combustion control system 20 further includes a controller 22 operatively associated with the fuel flow control device 24 for selectively manipulating the fuel flow control device 24 and with the air flow control device 26 for selectively manipulating the air flow control device 26. In operation, the control system 20 functions to maintain safe, efficient and environmental acceptable operation at any particular firing rate.

Figure 2:
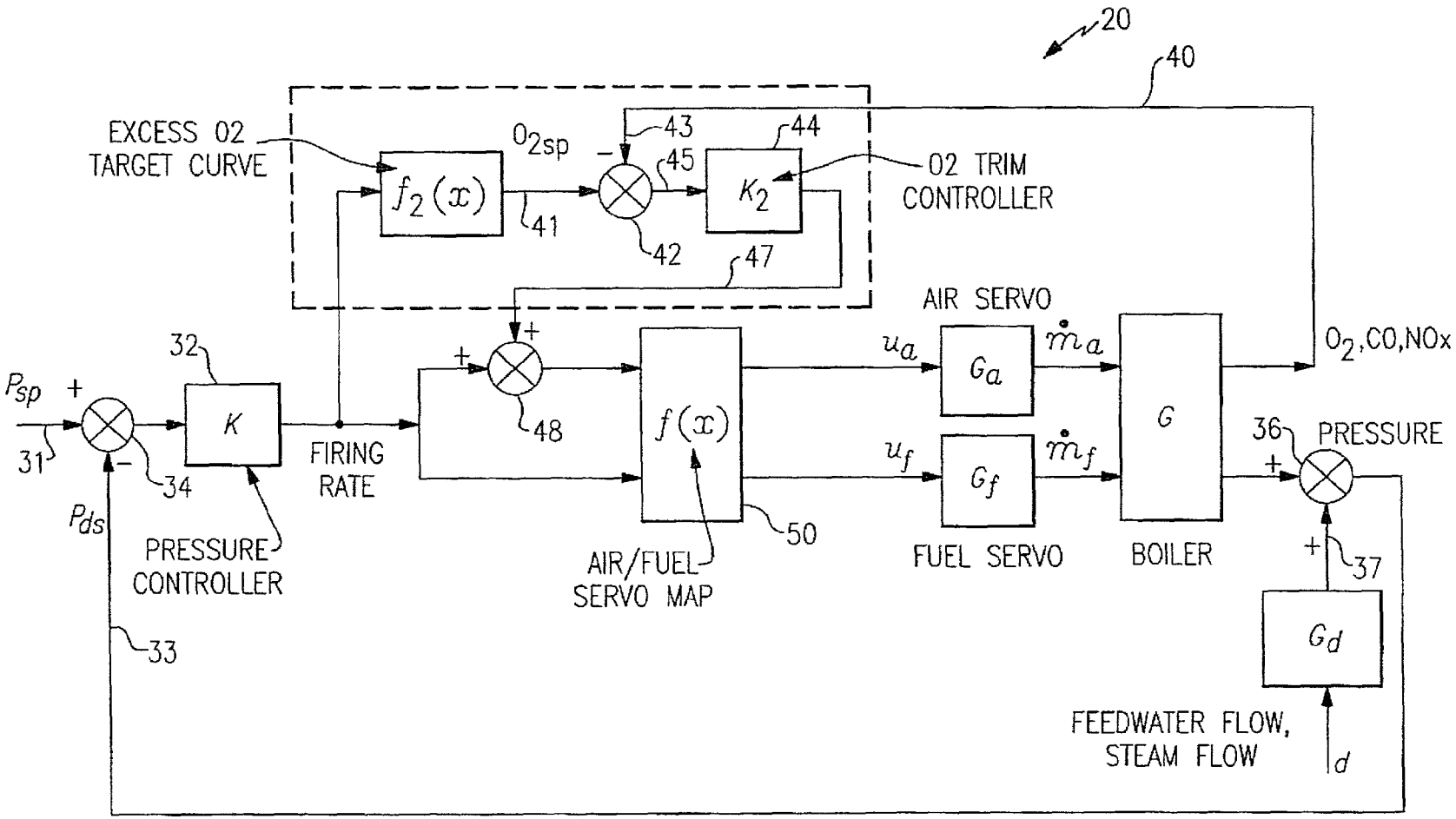
FIG. 2 is a block diagram of an exemplary embodiment of a parallel positioning combustion control system with oxygen trim control.

Referring now to FIG. 2, the combustion control system 20 depicted therein is exemplary of a conventional dynamic feedback control having a boiler steam pressure (or hot water temperature for a hot water boiler) control feedback loop 30, an oxygen level control feedback loop 40, and a fuel//air servo map 50. In FIG. 2, $\dot{m}_a$ represents the air mass flow rate and $\dot{m}_f$ represents the fuel mass flow rate. $G_a$ represents the air servo transfer function, $G_f$ represents the fuel servo transfer function, G represents the boiler transfer function, and $G_d$ represents the boiler water-side transfer function. Additionally, $f_2(x)$ represents an excess oxygen target curve, which is a load dependent (nonlinear) function relating set point oxygen content target values to firing rate.

The air servo transfer function, $G_a$, converts an air servo position, $u_a$, inputted to the air flow control device 26 to a corresponding air mass flow rate, $\dot{m}_a$. The fuel servo transfer functions, $G_f$, coverts a fuel servo function, $u_f$, inputted to the fuel flow control device 24 to a corresponding fuel mass flow rate, $\dot{m}_f$. The boiler transfer function, G, models the boiler fire-side operation and provides as output, a boiler steam pressure and flue gas excess oxygen content for an inputted fuel mass flow rate and an inputted air mass flow rate. The boiler water-side transfer function, $G_d$, translates an input change in a boiler water-side parameter, such as boiler water level, feed water mass flow rate, and/or steam (hot water) mass flow rate into a boiler pressure change.

The boiler feedback loop 30 includes a boiler pressure controller 32 that adjusts the burner firing rate in response to a change in one or more operating parameters impacting boiler steam pressure (hot water temperature) in order to maintain a desired set point pressure. The boiler pressure controller 32 receives as input a signal indicative of the change in the boiler steam pressure (hot water temperature) from a negative feedback circuit 34 attendant to a change in one or more water-side operating parameters, such as boiler water level, boiler feedwater mass flow rate, and boiler steam (hot water) mass flow rate, or a change in a fire-side operating parameter, such as fuel mass flow rate or air mass flow rate, reflected in a signal output from the addition circuit 36.

The controller 22 determines an adjusted firing rate as needed to maintain boiler load at the set point boiler pressure and uses that adjusted firing rate in controlling the fuel flow control device 24. The controller 22 selects the desired fuel servo position, $u_f$, associated with that firing rate from reference to the air/fuel servo map 50 programmed into the controller and repositions the fuel flow control 24 to the desired fuel servo position, $u_f$, which changes the fuel mass flow rate to the burner 24.

The controller 22 also uses the adjusted firing rate in controlling the air flow control device 26. If the controls system 20 includes an oxygen trim control feedback loop 40, as in the exemplary embodiment depicted in FIG. 2, the adjusted firing rate used by the controller 22 in selecting the desired fuel servo position, $u_\beta$, is further adjusted at an addition circuit 48 in response to an oxygen trim signal 47. An oxygen trim controller 44 generates the oxygen trim signal 47 based upon an error signal 45, for example by applying a PID function to the error signal 45. The error signal 45 is output from the negative feedback circuit 42 which receives as input a signal 43 indicative of the sensed excess oxygen content and a signal 41 indicative of a set point excess oxygen content for the adjusted firing rate selected by the controller 22 via reference to the excess oxygen target curve, $f_2$ (x), which as noted previously is a function of firing rate.

The controller 22 references the air/fuel servo map 50 programmed into the controller to select the air servo position, $u_a$, associated with the further adjusted firing rate, if the control system 20 includes an oxygen trim control feedback loop, or simply the adjusted firing rate, if no oxygen trim control feedback loop is included. The controller 22 then repositions the air flow control 26 to the selected air servo position, $u_a$, which changes the air mass flow rate to the burner 24.

Figure 3:
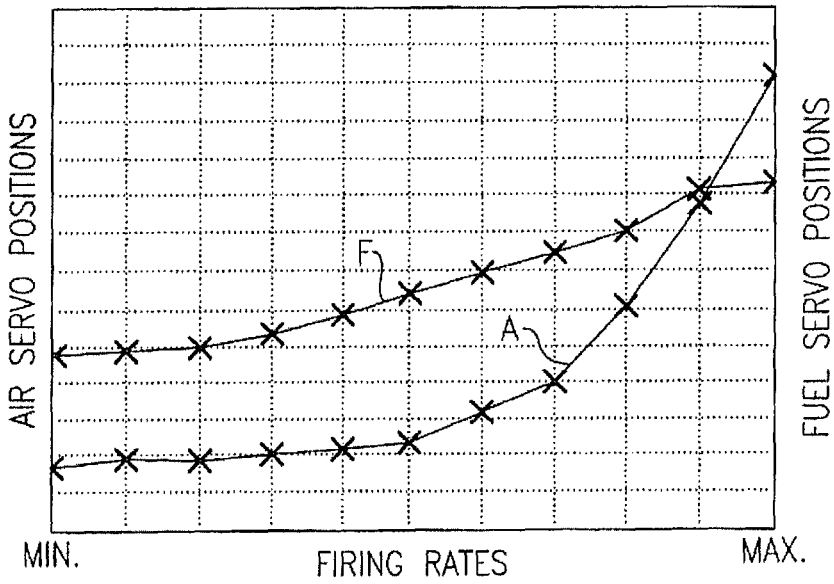
FIG. 3 is a graphical illustration of a map of an exemplary set of coordinated fuel and air servo positions verses firing rate.

Referring now to FIG. 3, the air/fuel servo map 50 comprises a set of coordinated positions representing the respective desired actuator positions for the fuel flow control device 24, curve F, and the air fuel flow control device 26, curve A, at each of a continuum of firing rates from the low firing point to the high firing point. The non-linear curves A and F which make up the air/fuel servo map 50 must be developed via a process known as commissioning when the technician installs the combustion control system 20 on the boiler. As noted previously, in conventional practice, the technician conducts the commissioning of the combustion control system using a trial and error process. In the method of the invention for commissioning the combustion control system 20, the trial and error process is eliminated through an iterative mapping process that uses an algorithm to estimate the optimum servo positions for one of the fuel flow control device 24 and the air flow control device 26 at any set servo position of the other.

One pair of coordinated actuator positions for each firing rate is found through setting the servo position of one of either the fuel flow control device or the air flow control device and manipulating the other of the fuel flow control device 24 or the air flow control device 26 for adjusting either the fuel flow or the air flow to the burner such that the amount of excess oxygen in the exhaust stack is maintained at the target excess oxygen level. Typically, the target excess oxygen level represents the combustion conditions at which the concentrations of carbon monoxide and other undesirable emissions, such as oxides of nitrogen, are kept at minimum level. In an embodiment of the method of the invention, the mapping process is conducted with first selecting the fuel flow control servo positions for the selected firing rates and then applying the method of the invention to determine the optimum air flow control servo position at each of the selected firing rates. In another embodiment of the method of the invention, the mapping process is conducted with first selecting the air flow control servo positions for the selected firing rates and then applying the method of the invention to determine the optimum fuel flow control servo position at each of the selected firing rates.

To commission the combustion control system 20, the technician performing the commissioning task needs to manually define the optimal fuel servo position, i.e. the position of the fuel flow control device 24, and the optimal air servo position, i.e. the position of the air flow control device 26, for the ignition point and the low firing rate as in conventional practice. After defining the fuel servo position and the air servo position for the ignition point and the low firing point, rather then proceeding by the conventional trial and error process, in the method of the invention for commissioning the combustion control system 20 an algorithm is used to assist in identifying a series of coordinated fuel and air actuator positions for a plurality of firing rate points over the entire operating range.

Figures 4, 4A:
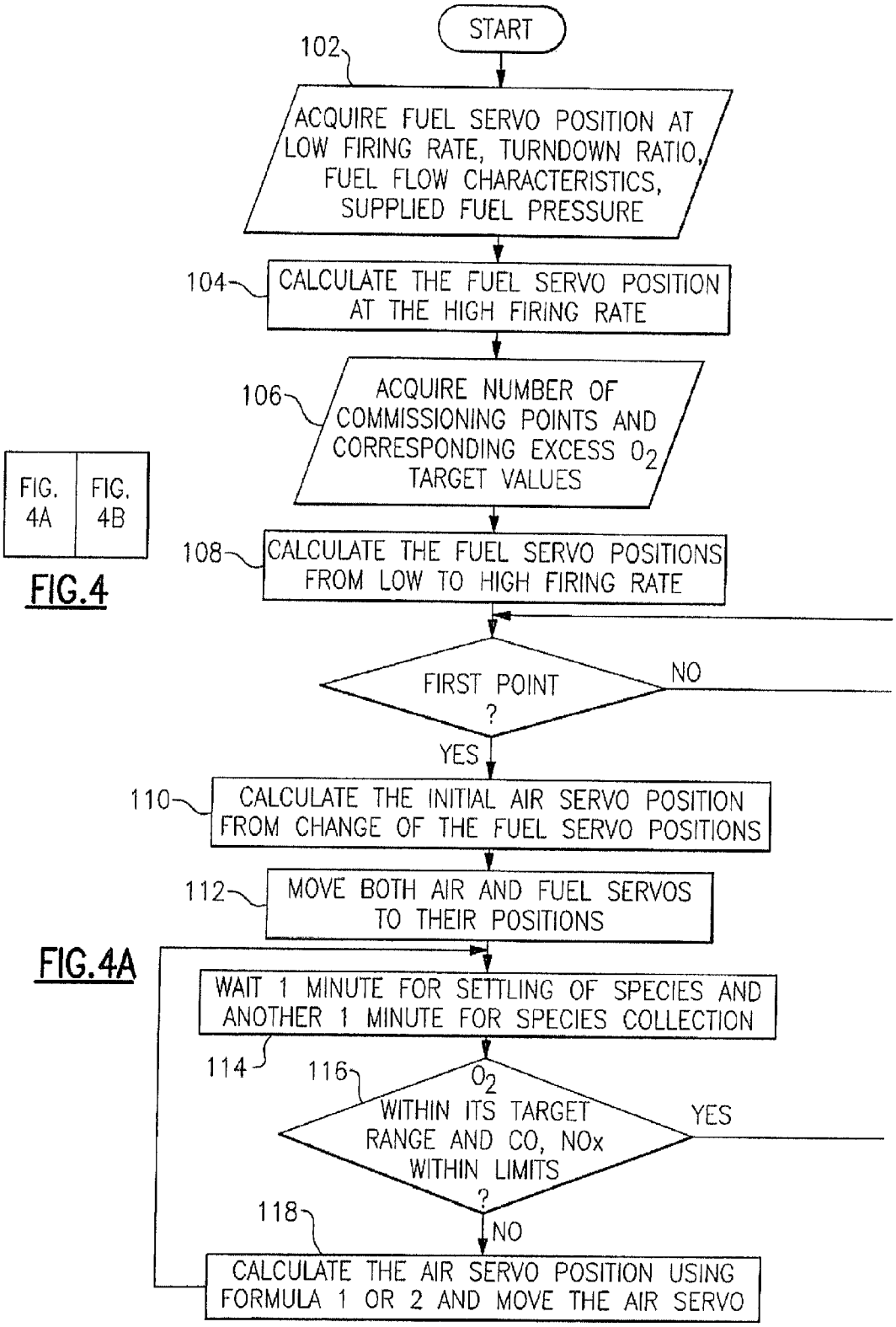
FIG. 4 is a process flow diagram illustrating an exemplary embodiment of a commissioning process of the combustion control system of FIG. 2 in accord with the present invention.
Figure 4B:
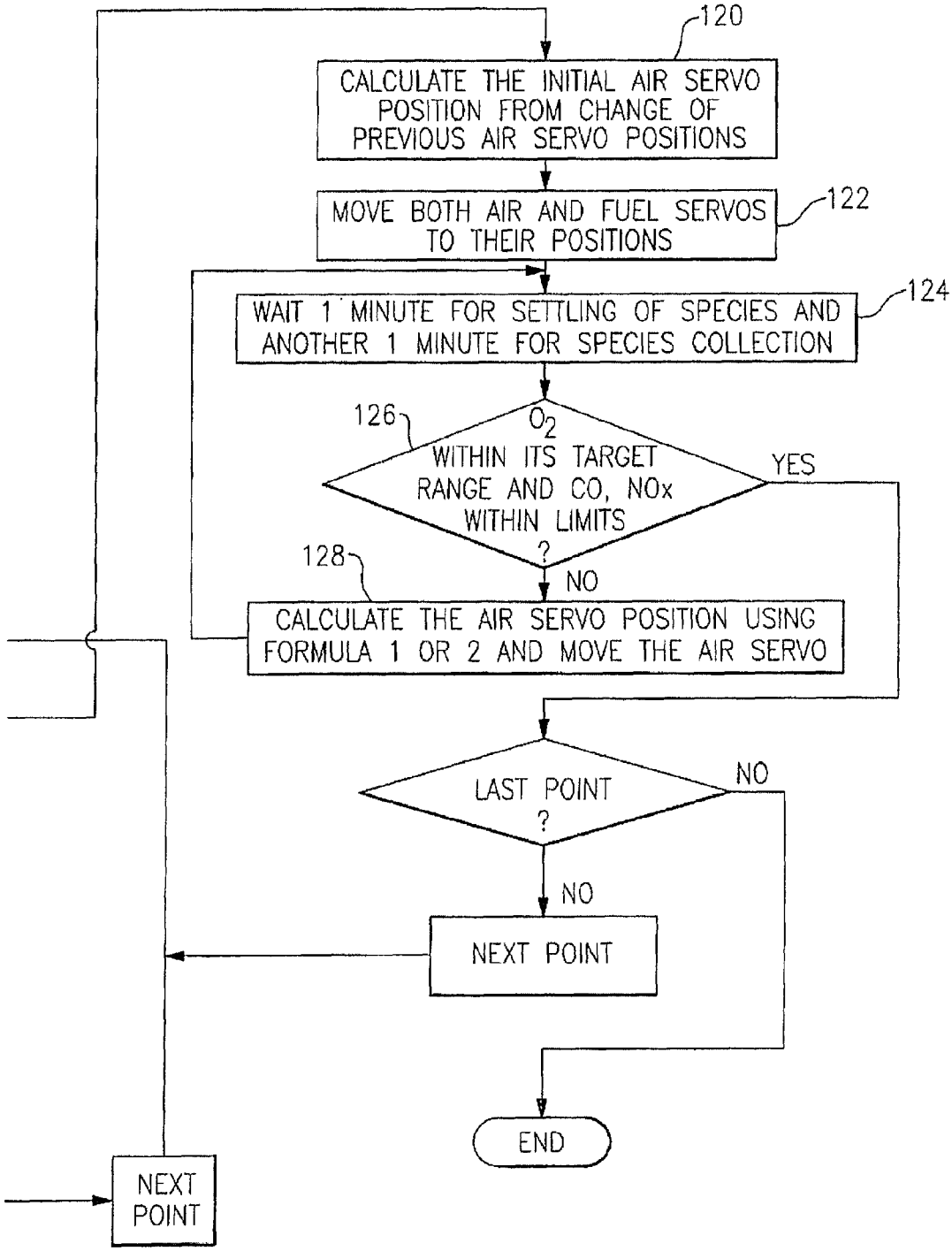

The method of the invention will be described hereinafter with reference to an exemplary embodiment wherein the air servo position is iterated upon for each firing rate at a set fuel servo position associated with the firing rate. Referring now the FIG. 4, there is presented a block diagram illustrating an exemplary application of an exemplary algorithm in accord with the assisted commissioning method of the invention. As a first step, designated as 102, in applying the assisted commissioning method of the invention, the controller 22 acquires the fuel servo position at low firing rate, the burner turndown ratio, the fuel flow characteristics, and the supplied fuel pressure. Using this acquired information, the controller 22 next, at step 104, calculates the fuel servo position at the high firing rate. At step 106, the controller 22 acquires the preselected number of commissioning points, that is, firing rates between the low firing rate and the high firing rate at which the coordinated fuel and air servo positions are to be determined, and the excess oxygen target values for each of those selected firing rate points from a preset look-up table.

At step 108, the controller 22 calculates the fuel servo position associated with each of the selected firing rate points from low to high firing rate. If the fuel flow characteristic versus servo position for the fuel flow control device 24 is relatively linear between the low firing rate and the high firing rate, the fuel servo positions are selected at evenly spaced increments of fuel servo position between the fuel servo position at the low firing rate and the fuel servo position at the high firing to correspond to an equal number of firing rates. However, if the fuel flow characteristic versus servo position for the fuel flow control device 24 is severely non-linear between the low firing rate and the high firing rate, the fuel servo positions are selected at evenly spaced increments of fuel flow between the minimum fuel flow at the low firing rate and the maximum fuel flow at the high firing to correspond to an equal number of firing rates.

For the first point at which commissioning is to occur, which is the first firing rate point of the selected points next greater than the low firing rate point, for example a firing rate in the vicinity of 3% of the maximum firing rate, the controller at step 110 calculates an initial air servo position for the first selected commissioning firing rate based on the change of the fuel servo positions between the first selected commissioning firing rate and the low firing rate. Next, at step 112, the controller 22 sets the fuel flow control device 24 according to the fuel servo position associated with that firing rate point as determined at step 108, and sets the air flow control device 26 according to the air servo position associated with that firing rate point as determined in step 110. After waiting a preselected period of time, such as for example about 1 minute for settling of combustion species (CO, excess $O_2$, NOx), a sampling of the combustion flue gases is obtained at step 114. Allowing a short period of time for species collection, such as for example another minute, the controller 22 next, at step 116, verifies whether the excess oxygen content is within an acceptable range of its target valve and whether the sensed CO and NOx emissions are within acceptable limits.

If the excess oxygen content is not within its target range and/or the CO or NOx emissions is not within acceptable limits, the controller 22 calculates, at step 118, a new servo position for the air flow control device 26 using one of the following two formulas:

$$\tilde{v}_t = \begin{cases} v_b + (v_a - v_b) \times \dfrac{(1 + O_2^t/0.209)(1+\delta) - (1 + O_2^b/0.209)(1+\delta)}{(1 + O_2^a/0.209) - (1 + O_2^b/0.209)(1+\delta)} & (1) \\ v_b + (v_a - v_b) \times \dfrac{O_2^t - O_2^b}{O_2^a - O_2^b} & (2) \end{cases}$$

where: $v_a$ denotes the air servo position at the previous firing rate and $v_b$ denotes the initial air servo position at the current firing rate, δ denotes the firing rate change between the current firing rate and the previous one, $O_2^t$, $O_2^a$ and $O_2^b$ represent the target excess oxygen content value, the measured excess oxygen content values at the servo positions $v_a$ and $v_b$, respectively. The first of the formulae is generally applied when the fuel flow control servo position at the second firing rate is different from the fuel flow control servo position at the first firing rate. The second of the formulae is generally applied when the fuel flow control servo position at the second firing rate is not changed.

Having calculated the new air servo position, the controller 22 returns to step 112 and moves the air flow control device 26 to the position associated with the new air servo position and again performs steps 112 through 118 repeatedly until the excess oxygen content is within an acceptable range of its target valve and the sensed CO and NOx emissions are within acceptable limits, or until a preselected maximum number of iterations has been performed.

When the excess oxygen content is within an acceptable range of its target valve and the sensed CO and NOx emissions are within acceptable limits, or after a preselected maximum number of iterations have been performed, the controller 22 proceeds to the next greater commissioning firing rate of the selected number of commissioning firing rates and, at step 120, calculates an initial air servo position for the next selected commissioning firing rate based on the change between the air servo positions associated with the two previous firing rates, that is the change between the determined air servo positions associated with the first commissioning firing the low firing rate or between the air servo positions associated with the two most previous commissioning firing rate points, as the case may be. Next, at step 122, the controller 22 sets the fuel flow control device 24 according to the fuel servo position associated with that firing rate point as determined at step 108, and sets the air flow control device 26 according to the air servo position associated with that firing rate point as determined in step 120. After waiting a preselected period of time, such as for example about 1 minute for settling of combustion species (CO, excess $O_2$, NOx), a sampling of the combustion flue gases is obtained at step 124. Allowing a short period of time for species collection, such as for example another minute, the controller 22 next, at step 126, verifies whether the excess oxygen content is within an acceptable range of its target valve and whether the sensed CO and NOx emissions are within acceptable limits.

If the excess oxygen content is not within its target range and/or the CO or NOx emissions is not within acceptable limits, the controller 22 calculates, at step 128, a new servo position for the air flow control device 26 using one of the following two formulas:

$$\tilde{v}_t = \begin{cases} v_b + (v_a - v_b) \times \dfrac{(1 + O_2^t/0.209)(1+\delta) - (1 + O_2^b/0.209)(1+\delta)}{(1 + O_2^a/0.209) - (1 + O_2^b/0.209)(1+\delta)} & (1) \\ v_b + (v_a - v_b) \times \dfrac{O_2^t - O_2^b}{O_2^a - O_2^b} & (2) \end{cases}$$

where: $v_a$ denotes the air servo position at the previous firing rate and $v_b$ denotes the initial air servo position at the current firing rate, δ denotes the firing rate change between the current firing rate and the previous one, $O_2^t$, $O_2^a$, and $O_2^b$ represent the target excess oxygen content value, the measured excess oxygen content value at the servo positions $v_a$ and $v_b$, respectively. As noted previously, the first of the formulae is generally applied when the fuel flow control servo position at the second firing rate is different from the fuel flow control servo position at the first firing rate. The second of the formulae is generally applied when the fuel flow control servo position at the second firing rate is not changed.

Having calculated the new air servo position, the controller 22 returns to step 122 and moves the air flow control device 26 to the position associated with the new air servo position and again performs steps 122 through 128 repeatedly until the excess oxygen content is within an acceptable range of its target valve and the sensed CO and NOx emissions are within acceptable limits, or until a preselected maximum number of iterations was been performed.

When the excess oxygen content is within an acceptable range of its target valve and the sensed CO and NOx emissions are within acceptable limits, or after a preselected maximum number of iterations have been performed, the controller 22 proceeds to the next greater commissioning firing rate of the selected number of commissioning firing rates and repeats steps 120 through 128 until the coordinated fuel and air servo positions have been determined for the last of the selected commissioning firing rates, at which point the commissioning process has been completed.

The coordinated sets of fuel flow control servo position and air flow control servo position developed at the various selected firing rates between the minimum firing rate and the maximum firing rate are stored in a memory bank operative associated with the controller 22 and are used to develop the air/fuel servo position map 50 exemplified by the graph illustrated in FIG. 3.

The method of commissioning a combustion control system of a steam/hot water boiler as disclosed herein provides a reliable formula based, iterative method to identify the coordinated air and fuel actuator positions. Compared to the typical trial and error method in conventional use, this formula based, iterative commissioning method provides improved precision of the coordinated fuel flow control and air flow control servo positions, significantly reduces the time required for commissioning, and reduces the tedious work and the dependency on the experience of the commissioning person associated with the conventional trial and error method of commissioning.

The foregoing description is only exemplary of the teachings of the invention. Those of ordinary skill in the art will recognize that various modifications and variations may be made to the invention as specifically described herein and equivalents thereof without departing from the spirit and scope of the invention as defined by the following claims.

The invention claimed is:

1. A method of commissioning a combustion control system for controlling operation of a boiler combustion system having a burner, a fuel flow control device operatively associated with said burner and an air flow control device operatively associated with said burner, the method including mapping a plurality of sets of coordinated servo positions for the fuel flow control device and the air flow control device at a plurality of selected firing rate points between a minimum firing rate and a maximum firing rate, said mapping process comprising, for at least one of said plurality of selected firing rate points, the steps of:

(a) determining one of either the servo position of the fuel flow control device or the servo position of the air flow control associated with the selected firing rate point;

(b) defining an excess oxygen content target value for the selected firing rate point;

(c) repositioning the other of the air flow control device or the fuel flow control device from a previous servo position known to be associated with a measured excess oxygen content value less than the excess oxygen content target value to a current servo position estimated to be associated with an excess oxygen content value greater than the target value;

(d) estimating an optimum servo position for the other of the air flow control device or the fuel flow control device at the selected firing rate by applying an algorithm comprising a function of the previous servo position, the current servo position, a measured value of the excess oxygen content at the previous servo position, a measured value of the excess oxygen content at the current servo position, and said excess oxygen target value; and (e) repeating steps (c) and (d) until the measured value of the excess oxygen content at the current servo position falls within a preselected range of said excess oxygen target value, thereby defining the optimum servo position for the other of the air flow control device or the fuel flow control device at the selected firing rate; and (f) saving the optimum servo position of the other of the air flow control device or the fuel flow control device at the selected firing rate and the servo position of the one of the fuel flow control device or the air flow control associated with the selected firing rate at step (a) as a coordinated set associated with the selected firing rate.

2. A method of commissioning a combustion control system as recited in claim 1 further comprising the step of terminating the repetition of steps (c) and (d) after a preselected number of iterations if the measured excess oxygen content does not fall within the preselected range of the excess oxygen content target value and defining the then current servo positions as a coordinated set associated with the selected firing rate.

3. A method of commissioning a combustion control system as recited in claim 2 further comprising the step of: repeating steps (a) to (f) until a coordinated set of fuel flow control servo position and air flow control servo position has been established at each of a desired plurality of selected firing rate points between the minimum firing rate and the maximum firing rate.

4. A method of commissioning a combustion control system as recited in claim 1, wherein said mapping process comprising, at least one of said plurality of selected firing rate points, the steps of:

(a) determining the fuel flow control servo position for the selected firing rate point;

(b) defining an excess oxygen content target value for the selected firing rate point;

(e) repositioning the air flow control device from a previous air servo position known to be associated with a measured excess oxygen content value less than the excess oxygen content target value to a current air servo position estimated to be associated with an excess oxygen content value greater than the target value;

(d) estimating an optimum air flow control servo position for the selected firing rate by applying an algorithm comprising a function of the previous air servo position, the current air servo position, a measured value of the excess oxygen content at the previous air servo position, a measured value of the excess oxygen content at the current air servo position, and said excess oxygen target value; and (e) repeating steps (c) and (d) until the measured value of the excess oxygen content at the current air servo position falls within a preselected range of said excess oxygen target value, thereby defining the optimum air flow control servo position at the selected firing rate; and (f) saving the optimum air flow control servo position at the selected firing rate and the fuel flow control servo position associated with the selected firing rate as a coordinated set associated with the selected firing rate.

5. A method of commissioning a combustion control system as recited in claim 4 wherein the step of estimating an optimum air flow control servo position for the selected firing rate by applying an algorithm comprising a function of the previous air servo position, the current air servo position, a measured value of the excess oxygen content at the previous air servo position, a measured value of the excess oxygen content at the current air servo position, and said excess oxygen target value comprises applying one of the following two formulae:

$$\tilde{v}_t = \begin{cases} v_b + (v_a - v_b) \times \dfrac{(1 + O_2^t/0.209)(1+\delta) - (1 + O_2^b/0.209)(1+\delta)}{(1 + O_2^a/0.209) - (1 + O_2^b/0.209)(1+\delta)} & (1) \\ v_b + (v_a - v_b) \times \dfrac{O_2^t - O_2^b}{O_2^a - O_2^b} & (2) \end{cases}$$

where: $v_a$ denotes the air servo position at the previous firing rate and $v_b$ denotes the initial air servo position at the current firing rate, $\delta$ denotes the firing rate change between the current firing rate and the previous firing rate, $O_2^t$, $O_2^a$, and $O_2^b$ represent the target excess oxygen content, the measured concentrations of excess oxygen content at the servo positions $v_a$ and $v_b$, respectively.

6. A method of commissioning a combustion control system as recited in claim 5 wherein the first of said formulae is applied when the fuel flow control servo position at the second firing rate is different from the fuel flow control servo position at the first firing rate.

7. A method of commissioning a combustion control system as recited in claim 5 wherein the second of said formulae is applied when the fuel flow control servo position at the second firing rate is not changed.

8. A method of commissioning a combustion control system as recited in claim 1 wherein said mapping process comprises, at least one of said plurality of selected firing rate points, the steps of:

(a) selecting the air flow control servo position for the selected firing rate point;

(b) defining an excess oxygen content target value for the selected air flow servo position;

(c) repositioning the fuel flow control device from a previous fuel servo position known to be associated with a measured excess oxygen content value less than the excess oxygen content target value to a current fuel servo position estimated to be associated with an excess oxygen content value greater than the target value;

(d) estimating an optimum fuel flow control servo position for the selected air servo position by applying an algorithm comprising a function of the previous fuel servo position, the current fuel servo position, a measured value of the excess oxygen content at the previous fuel servo position, a measured value of the excess oxygen content at the current fuel servo position, and said excess oxygen target value; and (e) repeating steps (c) and (d) until the measured value of the excess oxygen content at the current fuel servo position falls within a preselected range of said excess oxygen target value, thereby defining the optimum fuel flow control servo position at the selected air servo position; and (f) saving the optimum fuel flow control servo position at the selected air servo position and the selected air servo position servo position associated with the selected firing rate as a coordinated set associated with the selected firing rate.

* * * * *